US007509036B2

(12) United States Patent
Carr, Sr.

(10) Patent No.: US 7,509,036 B2
(45) Date of Patent: Mar. 24, 2009

(54) INLINE DOWNHOLE HEATER

(76) Inventor: Michael Ray Carr, Sr., 324 E. Union, Minden, LA (US) 71055

( * ) Notice: Subject to any disclaimer, the term of this patent is extended or adjusted under 35 U.S.C. 154(b) by 0 days.

(21) Appl. No.: 11/899,137

(22) Filed: Sep. 4, 2007

(65) Prior Publication Data

US 2008/0002954 A1 Jan. 3, 2008

Related U.S. Application Data

(63) Continuation-in-part of application No. 10/886,526, filed on Jul. 7, 2004, now abandoned.

(60) Provisional application No. 60/397,723, filed on Jul. 22, 2002.

(51) Int. Cl.
*F24H 1/10* (2006.01)

(52) U.S. Cl. ..... 392/478; 392/465

(58) Field of Classification Search ..... 392/478
See application file for complete search history.

(56) References Cited

U.S. PATENT DOCUMENTS

| | | | |
|---|---|---|---|
| 2,525,314 | A | 10/1950 | Rial |
| 2,808,110 | A | 10/1957 | Spitz |
| 2,893,490 | A | 7/1959 | Williams et al. |
| 5,539,853 | A | 7/1996 | Jamaluddin et al. |
| 2002/0023751 | A1 | 2/2002 | Neuroth et al. |
| 2005/0135796 | A1 | 6/2005 | Carr, Sr. |

*Primary Examiner*—Thor S Campbell
(74) *Attorney, Agent, or Firm*—Keaty Professional Law Corporation

(57) ABSTRACT

A well bore fluid is being heated to prevent paraffin build-up in the production line by an electrical heating element lowered into a pre-determined subterranean location. The heating element is controlled by a control unit that is connected to a temperature sensor, which detects temperature in the vicinity of the heating element and energizes an above-the-surface electric power source to deliver sufficient electric power to the electric heating element to keep the paraffin substance in a liquefied state.

23 Claims, 4 Drawing Sheets

INLINE DOWNHOLE HEATER

CROSS REFERENCE TO RELATED APPLICATIONS

This application is a continuation-in-part of my co-ending application, Ser. No. 10/886,526 filed on Jul. 7, 2004 now abandoned and entitled "Inline Oilfield or Pipeline Fitting Element," which is based on my provisional application Ser. No. 60/397,723 filed on Jul. 22, 2002, the full disclosures and priority of which are hereby claimed. This application also claims the priority of application Ser. No. 10/614,580 filed on Jul. 7, 2003 (now abandoned).

BACKGROUND OF THE INVENTION

This invention relates to an apparatus and method for heating fluid in a subterranean formation, which has poor flowabilty due to the buildup of paraffin, or asphaltene on the walls of the production tubing or in the well bore. More particularly, the present invention relates to an apparatus and method of improving flowabilty of subterranean formation fluid by using an inline heating method.

One of the problems associated with oil production is the deposition of paraffin or asphaltene on the walls of production tubing or the well bore. The oil is pumped to the surface or forced to the surface from a relatively hot area through a cool zone where the temperature of formation is less that the solidification temperature of paraffin. Once paraffin or asphaltene separate from the crude oil fluid flow, they tend to adhere to the production line walls causing a restriction in the tubing. Over time the paraffin builds up on the walls of the production tubing and significantly affects the production flow. As the crude oil is pumped to the surface, the gas from the reservoir also rises to the surface. Reservoir gas tends to decrease the reservoir pressure and increase the time the crude oil is flowing through the production tubing. As a consequence, the reduced flow of oil loses speed and pressure as it travels from downhole to the surface. The decreased temperature increases the viscosity of the oil and further reduces the flow rate.

Such phenomenon is well known in the field and various methods have been employed to solve the problem. One such method is the so-called "Hot Oil Treatment." According to the hot oil treatment method steam is pumped under significant pressure in the area between the casing and the tubing. The pressure applied during this process forces paraffin residue into the production formation. This method is ineffective as interaction of steam pressure in the producing zone frequently results in clogged perforations and ultimately the decline or loss of production. The pressure steam method is also time consuming, and requires down time to complete, is expensive and presents significant risks to the operator.

Another method that is conventionally used in the oil industry to treat paraffin deposits requires stopping on the production, retrieval of the tubing, cleaning by scraping or steam, the inner wall of the well string to remove the paraffin and asphaltene deposits and then replacing the tubing back into the well. This method is also time consuming and costly and does not prevent future paraffin deposits in the pipes. The method is merely a maintenance procedure that works for a short period of time. Additionally, the risk of loss of production while the well is shut-in, coupled with the maintenance expense, makes many wells unprofitable to produce if such method is used.

Still another commonly employed method is a chemical treatment using solvents that are introduced in the well bore in an effort to dissolve the paraffin deposits and improve the flow of crude oil.

All these methods and systems have minimal success in addressing the problem as it occurs. Additionally, the conventional solutions do not take into consideration the flash ignition prevention in the design. The conventional tools are single units with limited heating capabilities that cannot be extended or added to, to cover a greater zone of treatment. Furthermore, the electrical heating devices used in conventional downhole heaters tend to allow leakage at electrical connections or at wire feed-through areas, which caused serious problems in the volatile environment downhole.

One of the more serious problems is the failure of the conventional tools to detect and monitor downhole temperatures at the vicinity of the heater and thereby regulate the temperature in the critical areas. Another serious problem associated with conventional tools is failure to allow dumping of the fluid while at the bottom of the downhole fluid and crude oil while the heater is introduced in the flow path as part of the well string. Additionally, solid wall liners used in the heating devices do not prevent gas lock whereby gasses are prevented from escaping from the well bore tubing, which significantly impairs the production pressure.

The present invention contemplates elimination of drawbacks associated with conventional systems and provision of an inline downhole heater that can be controlled and regulated from the surface as it heats the oil passing through the production tubing.

SUMMARY OF THE INVENTION

It is, therefore, an object of the present invention to provide an inline heating apparatus that can be positioned as part of tubing in the well bore for heating the fluid as it passes from the hot temperature zone to the cold temperature zone.

It is another object of the present invention to provide a method of heating production fluid by positioning the heating apparatus as part of the well string in the locations where the paraffin is likely to solidify.

It is a further object of the present invention to provide an apparatus and method for heating fluid that can incorporate a number of heating assemblies for improving heating capabilities.

These and other objects of the present invention are achieved through a provision of an apparatus for heating a fluid flow to treat a well bore and retain paraffin and asphaltene in a liquefied state while traveling through a production tubing, or line. The well bore treating apparatus comprises an elongated hollow body sized and configured for extending a production line therethrough, said hollow body being adapted for positioning in a pre-determined location within the well bore. The hollow body has an inner housing surrounding the production line and an outer housing mounted in a spaced-apart surrounding relationship to said inner housing. The inner housing and the outer housing are maintained in a spaced-apart relationship by a plurality of transverse plates extending in the body, and wherein an annular space is defined between the inner housing and the outer housing.

The body is divided into a plurality of dry zones and wet zones defined in an annular space between the inner housing and the outer housing, although it may be sufficient that at least one dry zone and at least one wet zones be formed by the hollow body. The inner housing comprising a perforated wall portion located in the wet zone to facilitate fluid communication and heat transfer with the interior of the well bore.

A heating means comprising at least one heating element extends in the wet zone in a heat-transferring relationship to the production line, said heating means being operationally connected to an above-the-surface electric power source. A control means for controlling operation of the power source depending on current temperature conditions in the pre-determined location in the well bore is operationally connected to the heating element(s), said control means comprising a temperature sensor mounted on said housing and operationally connected to a control unit positioned on the surface.

The sensor generates a signal indicative of the ambient temperature near the heating element positioned in the well bore and sends the signal to a control unit positioned above the surface. The control unit is operationally connected to a pulse generator capable of being energized by the power source and transmitting electrical power to the subterranean location where the well bore treating apparatus is located. The heat from the heating element is transferred to the well bore fluid and then to the fluid in the production line, melting paraffin and asphaltene and preventing their solidification.

BRIEF DESCRIPTION OF THE DRAWINGS

Reference will now be made to the drawings, wherein like parts are designated by like numerals, wherein.

DETAILED DESCRIPTION OF THE PREFERRED EMBODIMENT

Figure 1:
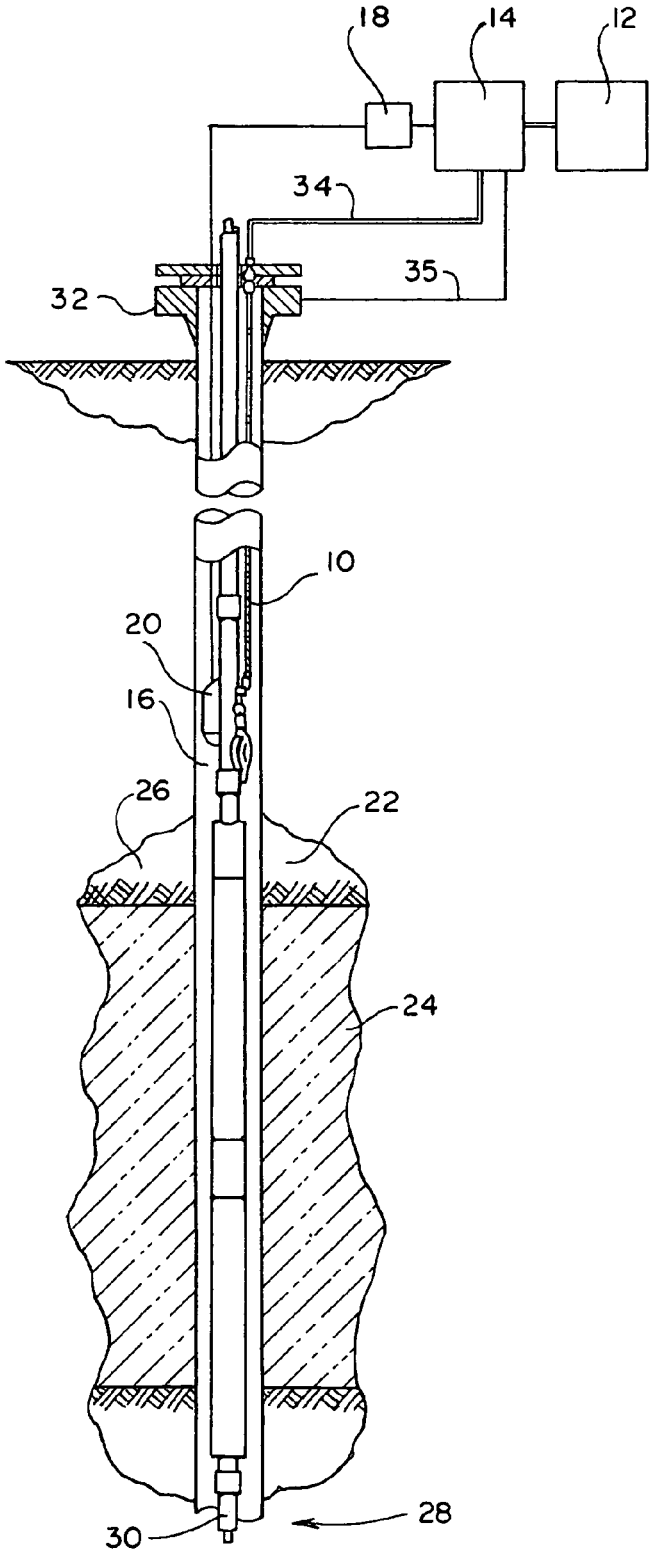
FIG. 1 is schematic view illustrating position of the apparatus in accordance with the present invention in a well bore.

Turning now to the drawings in more detail, numeral 10 designates the inline heating apparatus in accordance with the present invention. As can be seen in FIG. 1, the apparatus 10 is operationally connected to a transformer 12 and a pulse generator 14 positioned above the surface. The transformer 12 is adapted for connecting to a source of electrical power, for instance a 480-watt power source. The pulse generator 14 transmits electrical power to the heating elements positioned in the well 16 formed in the ground formation. The power generator 14 receives a signal from a temperature controller 18 that is operationally connected to a temperature sensor 20.

The apparatus 10 is positioned in a selected pre-determined location in the "cool zone" 22 of the well 16 wherein paraffin solidification is likely to occur. A hot zone 24 is usually located below the cool zone 22 and thus, it will not be necessary to position the apparatus zone in the zone 24. As can be seen in FIG. 1, the apparatus 10 can be connected end-to-end with a well bore string 26 which extends in the well bore 16 toward a production zone 28.

Extending through the central opening in the apparatus 10 and through the well bore string 26 is a production line, or production tubing 30, through which crude oil is pumped from the production zone 28 to the surface. The transformer 12, the power generator 14, and the temperature controller 18 are positioned on the surface above a wellhead 32.

Figure 2A:
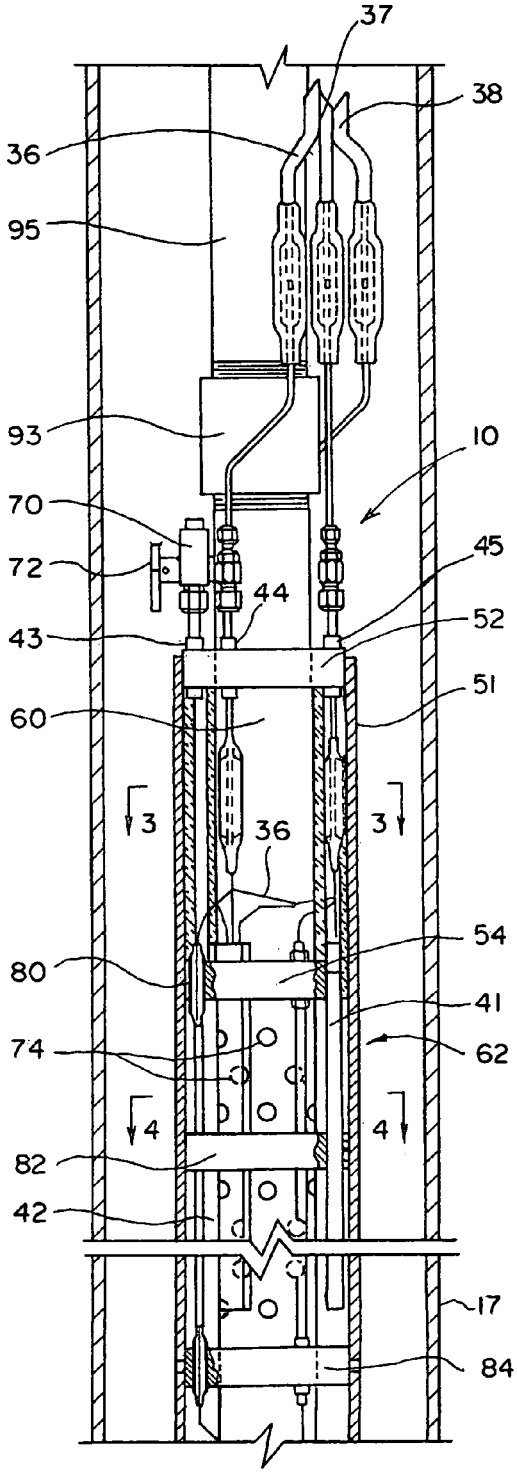
FIG. 2A and FIG. 2B illustrate portions of the apparatus of the present invention, with the interrupt lines introduced to fit the page size.
Figure 2B:
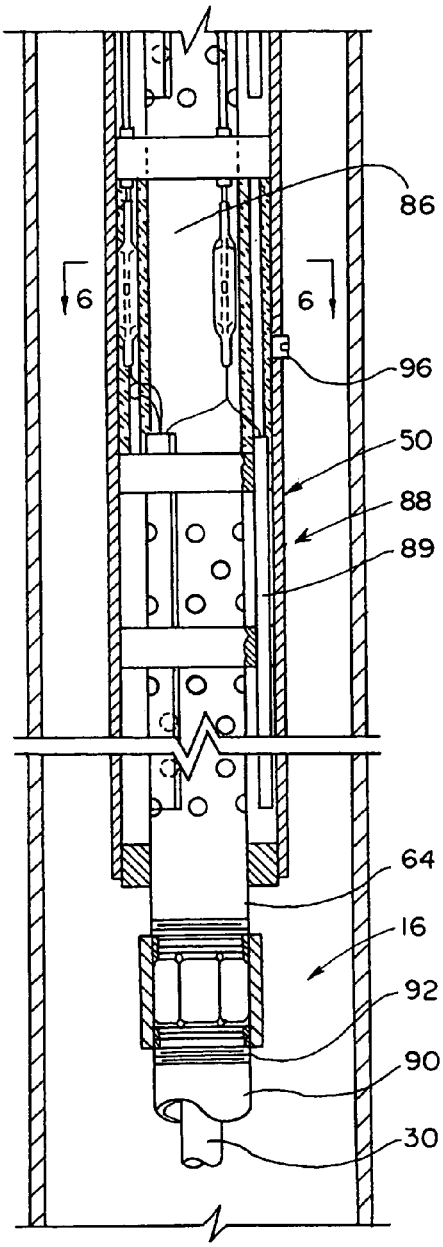
Figure 4:
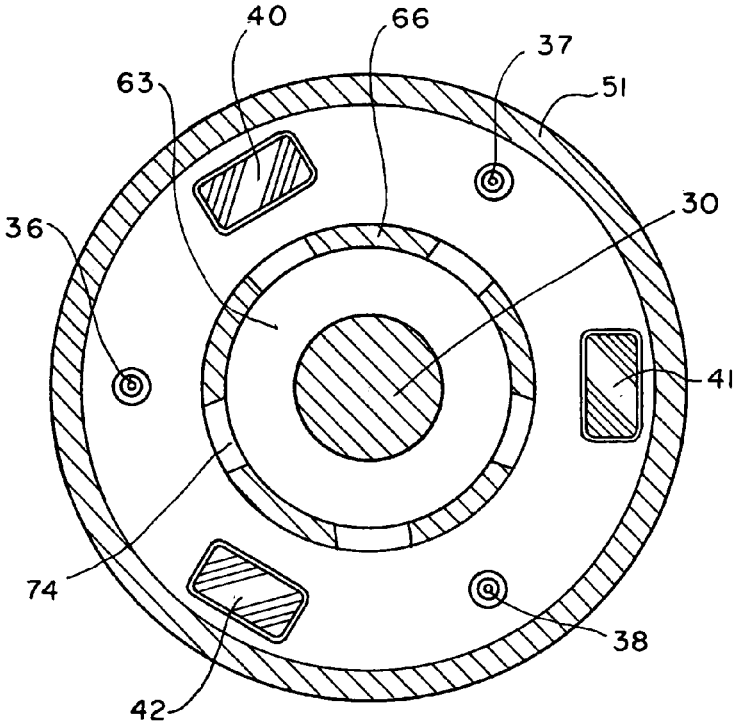
FIG. 4 is a cross-sectional view of the apparatus of the present invention taken along lines 4-4 in FIG. 2A.
Figure 3:
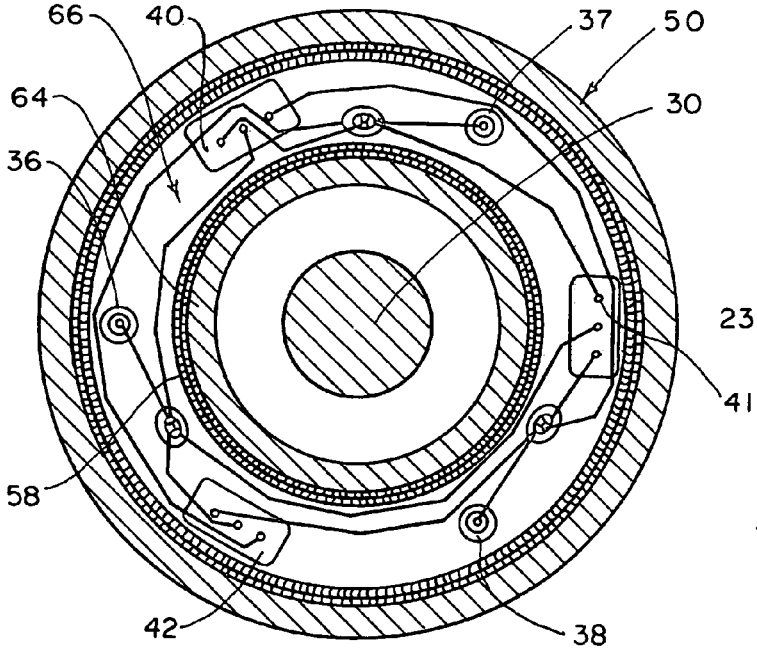
FIG. 3 is a cross-sectional view taken along lines 3-3 in FIG. 2A.
Figure 5:
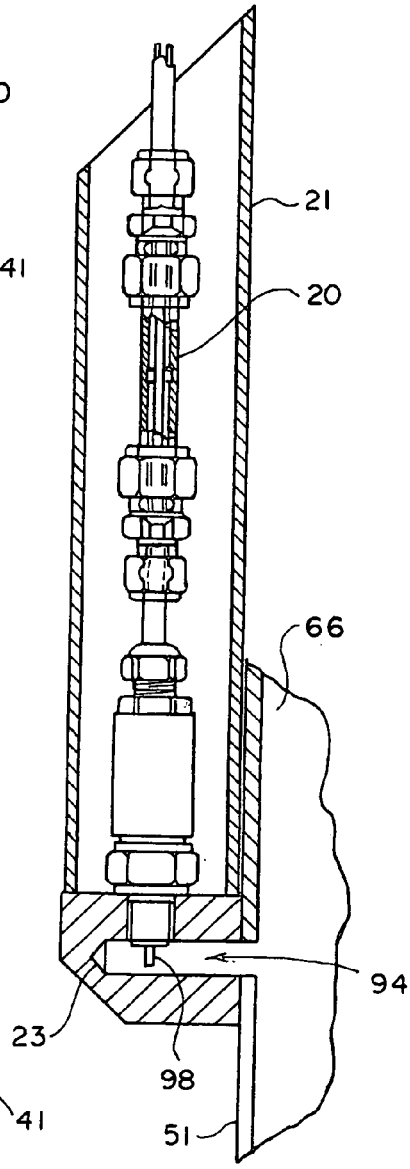
FIG. 5 is a detail, partially cross-sectional view of the temperature sensor device used in the apparatus of the present invention.

The apparatus 10 has distinct portions that for the ease of explanation are designated as "dry zone" and "wet zone." As can be seen in FIGS. 2A and 2B, three wires 36, 37, and 38 positioned in a cable 34 extend into the well 16 from the pulse generator 14. A cable 35 is a ground wire, and a cable 33 extends from the temperature controller 18 to the temperature sensor 20.

Each of the wires 36, 37, and 38 is connected to a respective heating element 40, 41 and 42. Each of the heating elements comprises an elongated heating member extending longitudinally in the elongated hollow body 50 of the apparatus 10. The body 50 comprises a top plate 52, that is sealed against the interior of the well bore 16 and carries the connecting wires 36, 37 and 38 that extend through the plate 52 into the interior of the housing 50. The wires 36, 37 and 38 may be Kapton-coated wires that are sealed with graphite seals 43, 44 and 45 that are crimped around the wires to prevent liquid from entering a the body 50. The plate 52 defines one end of a dry zone 60, while another transverse plate 54 defines another end of the dry zone 60. An opposite surface of the plate 54 defines one end of a wet zone 62, while still another transverse plate 84 separates the wet zone 62 from the next dry zone 86.

The body 50 comprises an outer housing 51 and an inner housing 64; the housings 51 and 64 are spaced apart, defining an annular space 66 therebetween. A first insulation layer 56 is located inwardly from the outer housing 51, and a second insulation layer 58 is located on the outside of the inner housing 64. The operating wiring and the connectors extending through the dry zone 60 are thereby protected from the heat generated in the well bore and from the heat generated by the heating elements of the apparatus 10.

Figure 8:
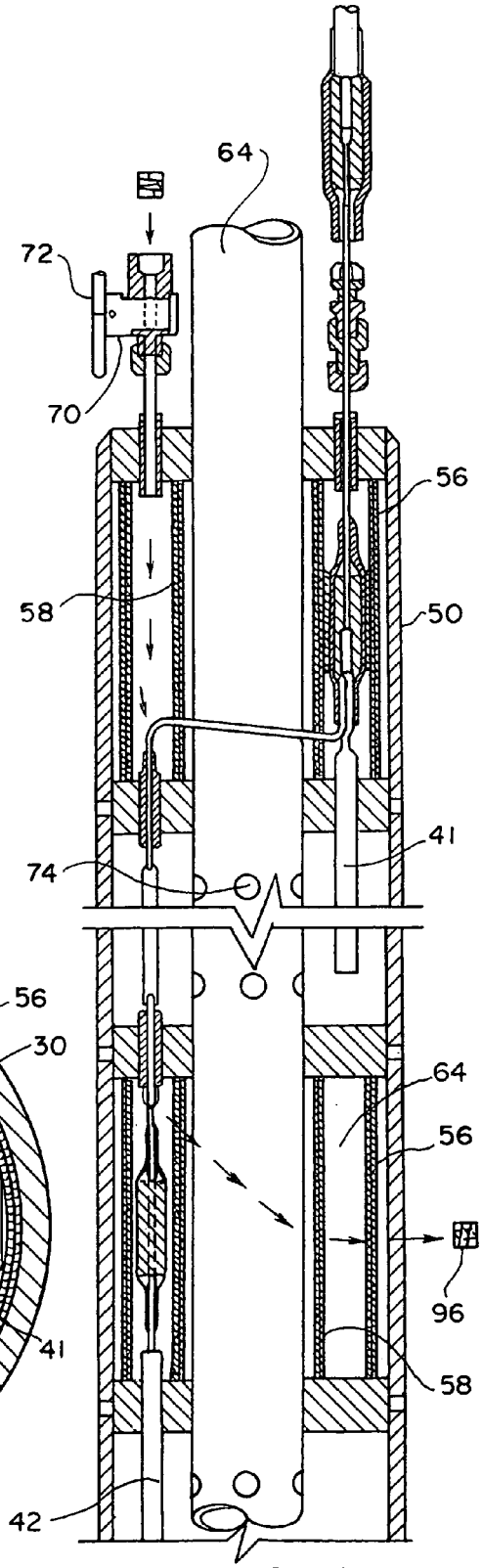
FIG. 8 is detail view illustrating purging of oxygen from the interior of the apparatus of the present invention.

The inner housing 64 extends formed longitudinally substantially through the entire length of the tool 10 and in a parallel relationship to the outer casing 51. The inner housing is sized and configured to allow extension of the production tubing 30 through a central opening 63 formed in the inner housing 64. A bushing 70 is mounted on the plate 52 in fluid communication with the annular space 66. A valve 72 is connected to the bushing 70 to allow evacuation of oxygen from the space 66 and introduction of a neutral gas into the annular space 66 as shown by arrows in FIG. 8. The neutral gas, for instance nitrogen prevents flash ignition in the electrical connection environment in the dry zone 60.

Figure 7:
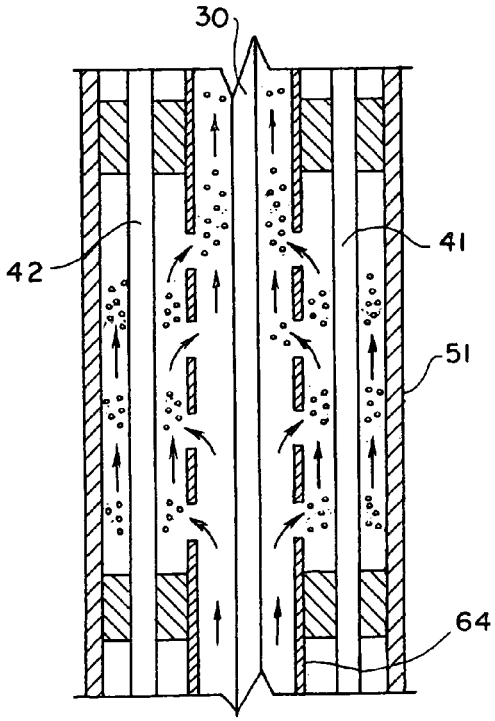
FIG. 7 is a schematic view illustrating the circulation flow in a wet zone of the apparatus of the present invention.
Figure 6:
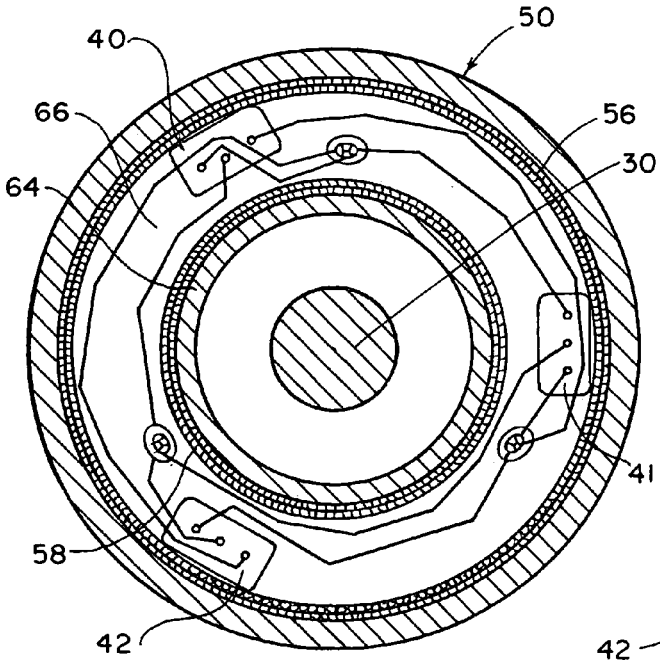
FIG. 6 is a cross-sectional view of the apparatus of the present invention taken along lines 6-6 in FIG. 2B.

The inner housing 64 extends both through the dry zone 60 and the wet zone 62. The portion of the inner housing 64 located in the wet zone 62 is provided with perforations 74 made through the wall of the inner housing 64. The perforations 74 allow heat exchange between the well bore liquid, such as salt water and the like, entering annulus 66 from the central opening 63 in the wet zone 62. The flow of fluids in the wet zones of the body 50 is schematically illustrated in FIG. 7.

The heating elements 40, 41 and 42 that extend in the wet zone 62 heat the liquid circulating through the perforations 74 and transfer the heat to the flow of crude oil passing through the production tubing 30. As a result, paraffin suspended in the crude oil flow does not cool to a temperature low enough to cause paraffin to be separated and attaching to the wall of the production line 30.

The wires 36, 37 and 38 extend from the dry zone 60 to the wet zone 62 by passing through a sleeve 80 positioned in the annulus 66 and subsequently through the entire apparatus 10 between the dry zones and the wet zones. Of course, the apparatus 10 can have more than one dry zone and more than one wet zone; the number of the zones and the number of heating elements will depend on the conditions of the well so that the heating elements are positioned in strategic locations for introducing a heating power to the crude oil.

If desired, a guide plate 82 can be positioned in the dry zone 62 for retaining the heating elements 41, 42 and 43 in alignment in relation to the central axis of the well casing 17 and the body 50. Another wet zone 88 can be formed next to the dry zone 86 and the tool 10 can be thus extended for providing several heating or wet zones in the well bore 16. The wet zone 88 has separate heating elements 89 that extend through the wet zone 88. Each wet zone has independent heating elements.

The top of the body 50 can be connected by a suitable coupling 93 to a well string sub 95, while a free end 90 of the body 50 can be provided with a threaded connector 92 that allows the apparatus 10 to be connected to another Sub (not shown) that forms a part of a well string.

The temperature sensor 20 detects the temperature in the area near the heating elements and sends a signal to the controller 18 at the surface. The sensor 20 is positioned within a temperature sensor housing 21, which is secured to the outer housing 51. The temperature sensor 20 is fittingly engaged in a receiver 23 that is secured at one end of the sensor housing 21. An opening 94 in the outer housing 51 admits temperature from the body 50 to the end 98 of the sensor 20 thereby allowing the sensor 20 to generate a signal of the current temperature and send the signal to the controller 18. The controller 18 determines whether the temperature has been raised sufficiently to maintain paraffins in a viscous state as a three-phase electric pulse generator 14 generates an electrical current and transmits it to the heating elements 40, 41, and 42. If the temperature is too high, the transformer generates less electricity. If the temperature is too low, the transformer is activated to supply more electric power to the downhole heating elements.

A bleed valve 96 (FIGS. 2B and 8) is set in the casing 51. A set screw opens the valve 96 to allow bleeding of oxygen from the dry zone and introduction of neutral gas, for instance nitrogen into the dry zones. The bleed valve 96 is removable to allow removal of oxygen.

The apparatus of the present invention can be also used for generating steam in a downhole location, which will require connection of the body 50 to a source of water. The heating elements, then activated all across the surrounding areas can be heated, thereby generating steam that would melt paraffin. The length of the tool 10 can be extended by adding multiple stages, dry zones followed by wet zones, followed by dry zones, etc. The number of heating assemblies will be determined by the rate of flow and diameter of the well. The multiple stage system dramatically increases the heat output variable thereby increasing the volume of fluid that can be heated.

The use of Kapton-coated wires and graphite seals crimped around the wires form a leak-proof seal around the electrical wires where they enter the dry zones 60. Of course, the use of an insulation coating in a hot temperature environment is not limited to the use of polymer Kapton, and other suitable insulation coating can be used.

The use of 480-watt 3-phase heating elements with three heating wires increases the heat output and makes the apparatus 10 more efficient and cost effective. The transformer 12 positioned on the surface eliminates fire hazard problems that can result from the use of a heat source downhole. The fiber optic source or probe 98 monitors downhole temperature and regulates operations at the surface.

The system of the present invention, when electrically connected elements are activated, controls electrical currents to the elements within SCR or pulse method. The pulse power supply is delivered by processors and through the downhole sensors. The control system 18 prevents the operating wires and heating elements from extending and contracting which extends the lifetime of the elements. Additionally, the pulsing system significantly reduces electrical consumption making the apparatus 10 more economical.

The present invention is designed to accommodate the insertion and placement of the downhole pump through the hollow inner core of the inner casing. As a consequence, the downhole pump can pass through the body 50 during normal installation. The perforated inner housing 64 prevents "gas locking" of the downhole production pump.

A particular advantage of the present invention is that it can be used in both horizontal and vertical piping systems and is not limited only to vertical placement. The apparatus 10 is a circulation heater as opposed to a probe heater, which is conventionally used in the field. It is envisioned that once the operator identified the cold zones, the apparatus 10 can be installed with the well bore string at a point approximately 100 to 200 feet below the deepest cold zone. In the flow or fluid lines, the problem areas can be identified by conventional tests and the apparatus 10 be installed within the line 50 to 100 feet before the paraffin build-up can occur.

In addition to preventing paraffin problems, the apparatus 10 can be utilized in low gravity heavy hydrocarbon recovery. If the producing zone requires heating to raise the temperature to convert the heavy hydrocarbons to light hydrocarbons, the apparatus 10 can be used as well. Rather than using a boiler system on the surface as a steam source, the apparatus 10 provides a tool to produce and deliver steam downhole directly to the producing line. In the injection well, the apparatus 10 can be installed as a production zone.

The heating elements 41, 42 and 43 are single end heat-generating elements; the apparatus 10 can therefore be safely used in a situation where the power source is electric power. Conventional tools utilize heating elements that must be terminated at each end (double-ended termination), which does not allow for extension of the heating element when heated. When necessary, the elongated heating elements can be extended to 20-feet length.

The pulse power supply delivered by the transformer 12 and the pulse generator 14 is regulated by processors receiving data from the downhole sensor 20. This control system prevents the heating elements from expanding and contracting in excess of the optimum operating environment, which extends the life of the elements to a significant degree. Many changes and modifications can be made to the apparatus and method of the present invention without departing from the spirit thereof. I therefore pray that my rights to the present invention be limited only by the scope of the appended claims.

I claim:

1. An apparatus for heating a wellbore fluid to treat a well bore in a cool zone, comprising:

an elongated hollow body sized and configured for extending a production line therethrough, said hollow body being adapted for positioning in a pre-determined location within a cool zone of the well bore, said hollow body comprising an inner housing surrounding at least a portion of the production line and an outer housing retained in a surrounding spaced-apart relationship to said inner housing, with an annular space formed between the inner housing and the outer housing, said hollow body being divided into at least one wet zone in fluid communication with the wellbore fluid and at least one dry zone adjacent said at least one wet zone;

a heating means extending longitudinally in said annular space through said at least one wet zone and said at least one dry zone in a heat-transferring relationship to production fluid flowing through said production line, said heating means being operationally connected to an above-the-surface power source; and a control means for controlling operation of said power means depending on current temperature conditions in the pre-determined location in the well bore.

2. The apparatus of claim 1, wherein said control means comprises a temperature sensor mounted on said hollow body and operationally connected to a control unit positioned on the surface.

3. The apparatus of claim 1, wherein said heating means comprises an electric power source.

4. The apparatus of claim 3, wherein said power source is capable of generating 480 volts.

5. The apparatus of claim 1, wherein said at least one wet zone is from said at least one dry zone by at least one transverse plate positioned in the outer housing in a transverse relationship to a longitudinal axis of the outer housing.

6. The apparatus of claim 1, wherein said heating means comprises exterior portion of operational wiring extending between the above-the-surface power source and the housing and an interior portion of the operational wiring positioned in said at least one dry zone.

7. The apparatus of claim 6, wherein at least a part of the exterior portion of said operational wiring carries a protective coating capable of protecting the operation wiring from high temperature environment within the well bore, and wherein graphite seals are mounted on said body at entry point of said exterior portion of the operational wiring into the body.

8. The apparatus of claim 5, wherein said at least one wet zone is mounted in fluid communication with interior of the well bore.

9. The apparatus of claim 1, wherein a first insulation layer is interposed between an outer wall of said inner housing and the annular space, and wherein a second insulation layer is interposed between an inner wall of the outer housing and the annular space.

10. The apparatus of claim 9, wherein said first insulation layer and said second insulation layer extend through said at least one dry zone.

11. The apparatus of claim 5, wherein said heating means comprises at least one heating element electrically connected at a first end to the above-the-surface power source and terminated at a second end, said at least one heating element extending in said at least one wet zone and said at least one dry zone.

12. The apparatus of claim 11, wherein said inner housing comprises a perforated wall portion located in said at least one wet zone to facilitate fluid communication and heat transfer with the interior of the well bore.

13. The apparatus of claim 6, wherein said outer housing carries a gas valve means for evacuating oxygen from said at least one dry zone and for connecting to a gas source to fill the annular space in said at least one dry zone with a neutral gas to prevent, flash ignition within the body.

14. The apparatus of claim 1, further comprising means for connecting the hollow body to a well string extending in the well bore and carrying the production line.

15. An apparatus for heating a fluid flow to treat a well bore, comprising:

an elongated hollow body sized and configured for extending a production line therethrough, said hollow body being adapted for positioning in a pre-determined location within a cool zone in the well bore, said body comprising an inner housing surrounding the production line and an outer housing mounted in a spaced-apart surrounding relationship to said inner housing, said inner housing and said outer housing being maintained in a spaced-apart relationship by a plurality of transverse plates extending in the body, and wherein an annular space is defined between the inner housing and the outer housing, said body comprising at least one dry zone and at least one wet zone, said inner housing comprising a perforated wall portion located in said at least one wet zone to facilitate fluid communication and heat transfer between said hollow body and interior of the well bore;

a heating means comprising at least one heating element extending longitudinally through said at least one dry zone and said at least one wet zone in said housing in a heat-transferring relationship to said production line, said heating means being operationally connected to an above-the-surface electric power source; and a control means for controlling operation of said power means depending on current temperature conditions in the pre-determined location in the well bore, said control means comprising a temperature sensor mounted on said housing and operationally connected to a control unit positioned on the surface.

16. The apparatus of claim 15, wherein a first insulation layer is interposed between an outer wall of said inner housing and the annular space, and wherein a second insulation layer is interposed between an inner wall of the outer housing and the annular space, said first insulation layer and said second insulation layer extending through said at least one dry zone.

17. The apparatus of claim 15, wherein said heating means comprises at least one elongated heating element electrically connected at a first end to the above-the-surface power source and terminated at a second end.

18. The apparatus of claim 15, wherein said outer housing carries a gas valve means for evacuating oxygen from said at least one dry zone and for connecting to a gas source to fill the annular space in said at least one dry zone with a neutral gas to prevent flash ignition within the body.

19. A method of heating a fluid flow to treat a well bore, comprising the steps of:

providing an elongated hollow body sized and configured for extending a production line therethrough, said hollow body being adapted for positioning in a pre-determined location within the well bore, said hollow body comprising an inner housing surrounding at least a portion of the production line and an outer housing retained in a surrounding spaced-apart relationship to said inner housing, with an annular space formed between the inner housing and the outer housing, said hollow body being divided into at least one wet zone in fluid communication with the wellbore fluid and at least one dry zone adjacent said at least one wet zone;

providing a heating means extending longitudinally in said annular space through said at least one wet zone and said at least one dry zone in a heat-transferring relationship to production fluid flowing through said production line, said heating means being operationally connected to an above-the-surface power source, said heating means comprising at least one heating element extending in said hollow body;

providing a control means for controlling operation of said power means depending on current temperature conditions in the pre-determined location in the well bore, said control means comprising at least one temperature sensor mounted on said outer housing in fluid communication with the interior of the hollow body;

positioning the hollow body and the heating elements in a cool zone of the well bore;

generating a signal with said temperature sensor indicative of an ambient temperature around said at least one heating element when said hollow body is positioned in a pre-determined location within the well bore; and transmitting said signal to said control means for energizing said power means for generating a sufficient power output to said at least one heating element for retaining paraffin in the well bore in a liquefied state, thereby preventing solidification of the paraffin in the production line.

20. The method of claim 19, further comprising the steps of allowing well bore fluid surrounding the production line to enter said at least wet zone in contact with said at least one heating element and transfer heat to the production line from said at least one heating element.

21. The method of claim 19, further comprising a step of providing operational wiring connecting the above-the-surface power source to said at least one heating element and positioning said wiring in said at least one dry zone.

22. The method of claim 21, further comprising the step of providing insulation to said operation wiring from temperatures in said well bore.

23. The method of claim 19, wherein the inner housing is provided with perforated sidewall in said at least one wet zone to facilitate heat exchange between said at least one heating element and fluid in said well bore.

* * * * *